US008418846B2

(12) United States Patent
Tanbo

(10) Patent No.: US 8,418,846 B2
(45) **Date of Patent: *Apr. 16, 2013**

(54) PACKAGE OF ROD-SHAPED SMOKING ARTICLES AND A BLANK THEREFOR

(75) Inventor: Hitoshi Tanbo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 110 days.

This patent is subject to a terminal disclaimer.

(21) Appl. No.: 12/276,913

(22) Filed: Nov. 24, 2008

(65) Prior Publication Data

US 2009/0078599 A1 Mar. 26, 2009

(30) Foreign Application Priority Data

May 30, 2006 (JP) ..... 2006-149927

(51) Int. Cl.
*B65D 85/10* (2006.01)
*B65D 85/00* (2006.01)

(52) U.S. Cl.
USPC ..... 206/268; 206/273; 229/189

(58) Field of Classification Search ..... 206/259, 206/268, 242, 265, 271, 273, 275, 272, 258; 229/160.1, 189, 198, 186, 182, 198.1–198.3, 229/182.1
See application file for complete search history.

(56) References Cited

U.S. PATENT DOCUMENTS

| | | | | |
|---|---|---|---|---|
| 1,299,683 | A * | 4/1919 | Crowell | 229/125.37 |
| 2,932,439 | A * | 4/1960 | Sparling | 229/182 |
| 5,143,282 | A * | 9/1992 | Pham | 229/160.1 |
| 5,478,011 | A | 12/1995 | Pham | |
| 5,833,060 | A * | 11/1998 | Draghetti et al. | 206/268 |
| 6,457,580 | B1 * | 10/2002 | Focke et al. | 206/259 |
| 6,591,982 | B2 | 7/2003 | Focke et al. | |
| 2003/0173249 | A1 * | 9/2003 | Nemoto | 206/592 |
| 2004/0055909 | A1 * | 3/2004 | Gamberi et al. | 206/271 |
| 2004/0144661 | A1 | 7/2004 | Lutzig | |
| 2005/0224375 | A1 * | 10/2005 | Focke et al. | 206/259 |

FOREIGN PATENT DOCUMENTS

| | | | |
|---|---|---|---|
| EP | 04145322 | A2 | 2/1991 |
| JP | 4-62937 | B2 | 10/1992 |
| JP | 7-88070 | B2 | 9/1995 |
| JP | 2002-526333 | A | 8/2002 |
| JP | 2004-524228 | A | 8/2004 |
| JP | 2004-526637 | A | 9/2004 |

* cited by examiner

*Primary Examiner* — Steven A. Reynolds
(74) *Attorney, Agent, or Firm* — Birch, Stewart, Kolasch & Birch, LLP

(57) ABSTRACT

A hinged-lid package of filter cigarettes has a box (2) with an inner frame (10) and a lid (6) that opens/closes the box (2). Four corner edges of the box (2) which extend in the longitudinal direction of the box (2), are formed into longitudinal edges (16) having an arc-like shape in cross section of the box (2). The arc-like shape of the longitudinal edges (16) is formed with a plurality of longitudinal grooves made only in the inner surface of the box (2). The package has a reinforcement patch (64) arranged in the box (2) across the longitudinal grooves.

12 Claims, 6 Drawing Sheets

PACKAGE OF ROD-SHAPED SMOKING ARTICLES AND A BLANK THEREFOR

This application is a Continuation of copending PCT International Application No. PCT/JP2007/060051 filed on May 16, 2007, which designated the United States, and on which priority is claimed under 35 U.S.C. §120. This application also claims priority under 35 U.S.C. §119(a) on Patent Application No. 2006-149927 filed in Japan on May 30, 2006. The entire contents of each of the above documents is hereby incorporated by reference into the present application.

TECHNICAL FIELD

The present invention relates to a package of rod-shaped smoking articles, such as cigarettes and filter cigarettes, and a blank for the package.

BACKGROUND ART

A package of this type is generally called a hinged-lid package. The hinged-lid package has a shape of a rectangular parallelepiped as a whole and includes four corner edges extending in its longitudinal direction. Such a package accommodates an inner pack. The inner pack usually contains a bundle of twenty rod-shaped smoking articles arranged in tiers and an inner wrapper that wraps the bundle. The inner pack has four edges extending in the longitudinal direction of the rod-shaped smoking articles, and each of these edges has a rounded outer shape.

When the inner pack is put into the package, wasted spaces are created between the rounded edges of the inner pack and their respective corner edges of the package, respectively. Moreover, the package has a shape that is hard to hold because of its corner edges.

A package disclosed in Patent Document 1 therefore has four corner edges each formed into an arc-shaped longitudinal edge. A machine and method of manufacturing such a package are disclosed, for example, in Patent Document 2.

Patent Document 1: Published Examined Patent Application No. 4-62937

Patent Document 2: Published Examined Patent Application No. 7-88070

DISCLOSURE OF THE INVENTION

Patent Document 1 does not clearly disclose a method of making corner edges of a package into arc-shaped longitudinal edges, whereas Patent Document 2 describes means and method for making arc-shaped longitudinal edges. In other words, according to Patent Document 2, each of the arc-shaped longitudinal edges is realized if a blank for the package is provided with parallel fold lines, or more specifically, parallel indented lines. These indented lines disfigure the package as they are visible from the outside of the package.

The fabrication of the arc-shaped longitudinal edges requires not only the folding along the indented lines but also a process for bending areas between the indented lines in the shape of an arc. For this reason, the package described in Patent Document 2 cannot be fabricated by using an ordinary wrapping machine.

It is an object of the invention to provide a package that includes arc-shaped longitudinal edges that do not cause disfigurement, can be fabricated by using an ordinary wrapping machine, and is capable of sufficiently retaining the strength thereof.

In order to achieve the above object, the package of rod-shaped smoking articles according to the invention comprises a box including an open end and containing an inner pack for rod-shaped smoking articles, the box further including a longitudinal edge, which extends in a longitudinal direction of the box to have an arc-like shape in cross section of the box, to be located in at least one corner edge, the arc-like shape of the longitudinal edge is realized by a plurality of longitudinal grooves which are formed only in an inner surface of the longitudinal edge and extend in the longitudinal direction of the box; a lid connected to the box through a hinge, for opening/closing the open end of the box; and a reinforcing element provided to the box, for maintaining the arc-like shape of the longitudinal edge.

In the package, the longitudinal grooves making the longitudinal edge into the arc-like shape are arranged only in the inner surface of the box, so that the longitudinal grooves are not exposed in an outer surface of the box. The longitudinal grooves absorb a difference generated between arc length of the inner surface of the arc-shaped longitudinal edge and arc length of an outer surface of the longitudinal edge, and make smooth the outer surface of the longitudinal edge. The longitudinal grooves reduce the strength of the longitudinal edge. This strength decrease is compensated by the reinforcing element, and the longitudinal edge maintains the arc-like shape thereof.

More specifically, the reinforcing element is placed in the inner surface of the box and may include at least one reinforcement patch arranged across the longitudinal grooves. Such a reinforcement patch is preferably positioned near the open end of the box. In this case, the reinforcement patch is made of fluid glue applied onto the inner surface of the box. The applied glue enters the longitudinal grooves and is solidified therein, forming the reinforcement patch.

The reinforcing element may include a garnish layer covering an entire outer surface of the box. The garnish layer is made of aluminum or synthetic resin. Such a garnish layer covers up the lack of the thickness for the longitudinal edge, attributable to the presence of the longitudinal grooves, and increases the strength of the longitudinal edge, that is, of the box.

The box may have the arc-shaped longitudinal edge in each of four corner edges extending in the longitudinal direction of the box. The lid includes four longitudinal edges corresponding to the longitudinal edges of the box. The longitudinal edges of the lid can also be made in an arc-like shape in cross section of the lid.

A bottom wall of the box and an upper wall of the lid each include two transverse edges extending orthogonal to the longitudinal direction of the box. Each of the transverse edges can also have an arc-like shape in longitudinal section of the box and lid.

The box includes a box body and an inner frame provided to the box body for forming the open end of the box. The inner frame is formed in the shape of letter "U" enclosing the inner pack and has two corner edges located in a front wall-side of the box. In this case, the two corner edges of the inner frame can be formed in an arc-like shape as with the longitudinal edges of the box.

The inner frame further has two lateral edges positioned in a rear wall-side of the box. The lateral edges may be formed in an arc-like shape as with the longitudinal edges of the box. In this case, the inner frame holds the inner pack of the rod-shaped articles so as to enclose the inner pack within the box.

The inner frame may include a garnish layer at least in an outer surface thereof. The garnish layer is preferably made of the same material as in the garnish layer of the box.

The present invention further provides a blank for fabricating the above package. The blank comprises a main section for forming a box, which extends in a longitudinal direction of the blank, and a sub section for forming a lid, which is connected to one end of the main section through a hinge. The main section includes a rear panel, a bottom panel and a front panel for forming a rear wall, a bottom wall and a front wall of the box, which are connected together in the longitudinal direction through transverse fold lines in the order from the sub section side; inner and outer side flaps for forming interior and exterior portions of side walls of the box, which are connected to both sides of the rear and front panels through longitudinal fold lines, at least one of the longitudinal lines being produced by a plurality of longitudinal grooves which are only formed in an inner face of the blank and extend along the longitudinal fold line; and at least one reinforcement position defined in an inner face of the main section to place a reinforcing element for the longitudinal fold line formed of the longitudinal grooves.

The reinforcement position is preferably located on the sub section side. The blank is made of longitudinally-grained cardboard. The longitudinally-grained cardboard includes fibers arranged in the longitudinal direction of the blank.

Because of the arc-shaped longitudinal edge provided in at least one of the corner edges extending in the longitudinal direction of the package, the package has a unique appearance. The outer surface of the longitudinal edge is virtually smooth, so that the package has fine appearance. Since the box of the package is provided with the reinforcing element for the longitudinal edge, that is, the reinforcement patch, the shape of the open end of the box is stably retained. This enables a smooth opening/closing operation of the lid.

Other advantages of the invention will be clarified in the attached drawings and "Best Mode of Carrying out the Invention" below.

BEST MODE FOR CARRYING OUT THE INVENTION

Figure 1:
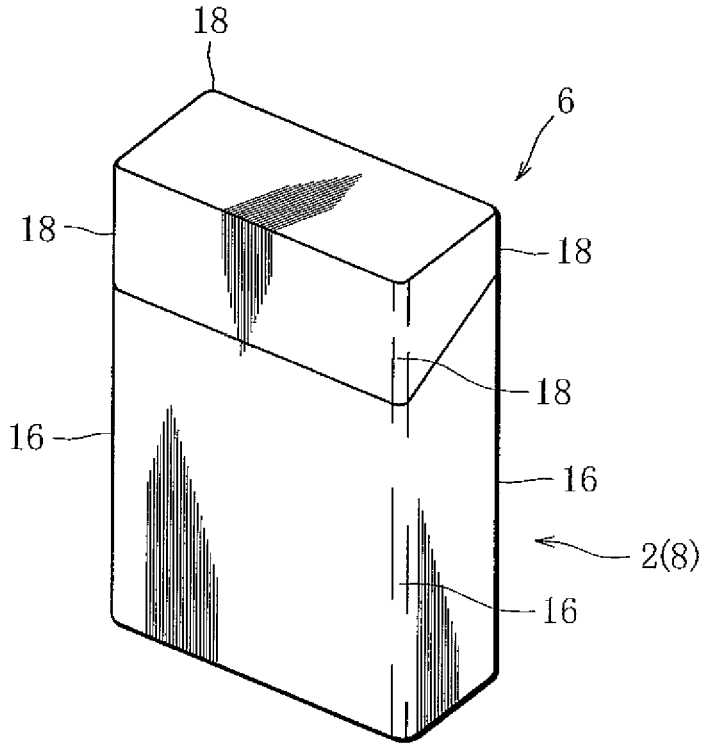
FIG. 1 is a perspective view showing a closed state of a package of a first embodiment.

A hinged-lid package of a first embodiment shown in FIG. 1 has a rectangular parallelepiped shape and is covered with a film wrapping material with a tear tape. The film wrapping material is not shown in FIG. 1. The package includes a box 2, which has an opening in an upper end thereof. A lid 6 is connected to a rear edge of the open end of the box 2 through a self hinge 4. The lid 6 pivots on the self hinge 4, to thereby open/close the open end of the box 2.

Figure 2:
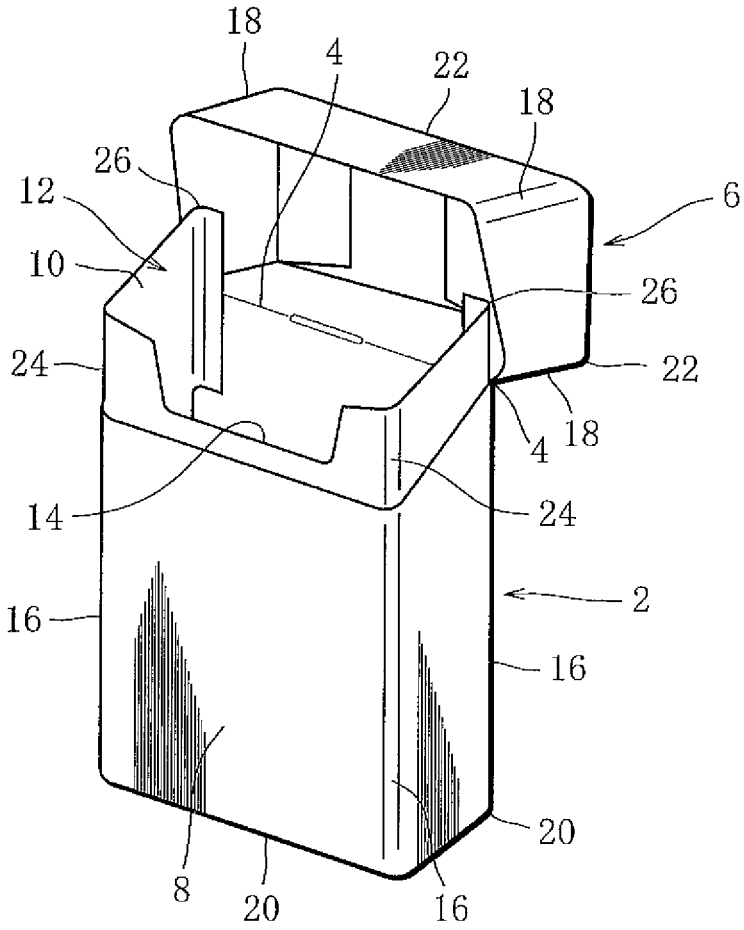
FIG. 2 is a perspective view showing an open state of the package of FIG. 1.

To be more specific, as illustrated in FIG. 2, the box 2 includes a box body 8, and the box body 8 has a slanted opening in an upper end thereof. The box 2 further includes an inner frame 10. The inner frame 10 has a substantially U-like shape. The inner frame 10 is partially inserted into the box body 8. The inner frame 10 has an end protruding from the opening of the box body 8 and forming an open end 12 of the box 2.

The inner frame 10 then has a front wall exposed outside of the box body 8. In the front wall, there is formed a substantially U-shaped cut 14.

The lid 6 is formed into a box. The lid 6 is capable of closing the open end 12 of the box 2 so as to cover the open end portion of the box 2, that is, a projecting portion of the inner frame 10. In other words, the lid 6 has a slanted opening in a lower end thereof. When the lid 6 is closed, the openings of the lid 6 and the box body 8 are engaged with each other.

As is apparent from FIGS. 1 and 2, the box body 8 includes arc-shaped longitudinal edges 16 as four corner edges that extend in a longitudinal direction of the box body 8. The arc-shaped longitudinal edges 16 each have an arc-like shape in cross section of the box body 8. Four corner edges of the lid 6, which extend in the longitudinal direction of the box body 8, are formed into arc-shaped longitudinal edges 18 similar to the arc-shaped longitudinal edges 16. When the lid 6 is in a closed position, the arc-shaped longitudinal edges 18 of the lid 6 coincide with the respective arc-shaped longitudinal edges 16 of the box body 8. The arc-shaped longitudinal edges 16 and 18 are collinearly arranged.

The inner frame 10 has two arc-shaped longitudinal edges 24 corresponding to the two arc-shaped longitudinal edges 16 on the front wall side of the box body 8, and two arc-shaped longitudinal edges 26 corresponding to the two arc-shaped longitudinal edges 16 on a rear wall side of the box body 8. The arc-shaped longitudinal edges 24 and 26 each have an arc-like shape as with the arc-shaped longitudinal edges 16 of the box body 8, and are engaged with the respective arc-shaped longitudinal edges 16 from inside.

Figure 3:
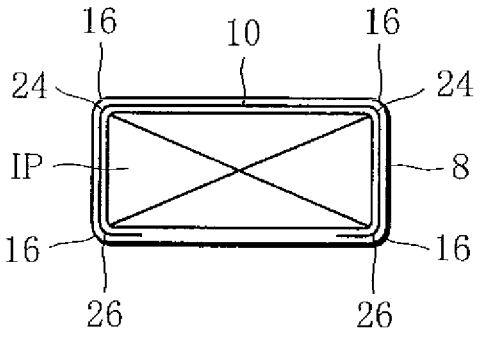
FIG. 3 is a cross-sectional view of the package shown in FIGS. 1 and 2.

As illustrated in FIG. 3, an inner pack IP contained in the box body 8 is held so as to be enclosed in the inner frame 10. The inner pack IP includes a bundle of twenty filter cigarettes arranged in tiers and an inner wrapping material that wraps the bundle.

Figure 4:
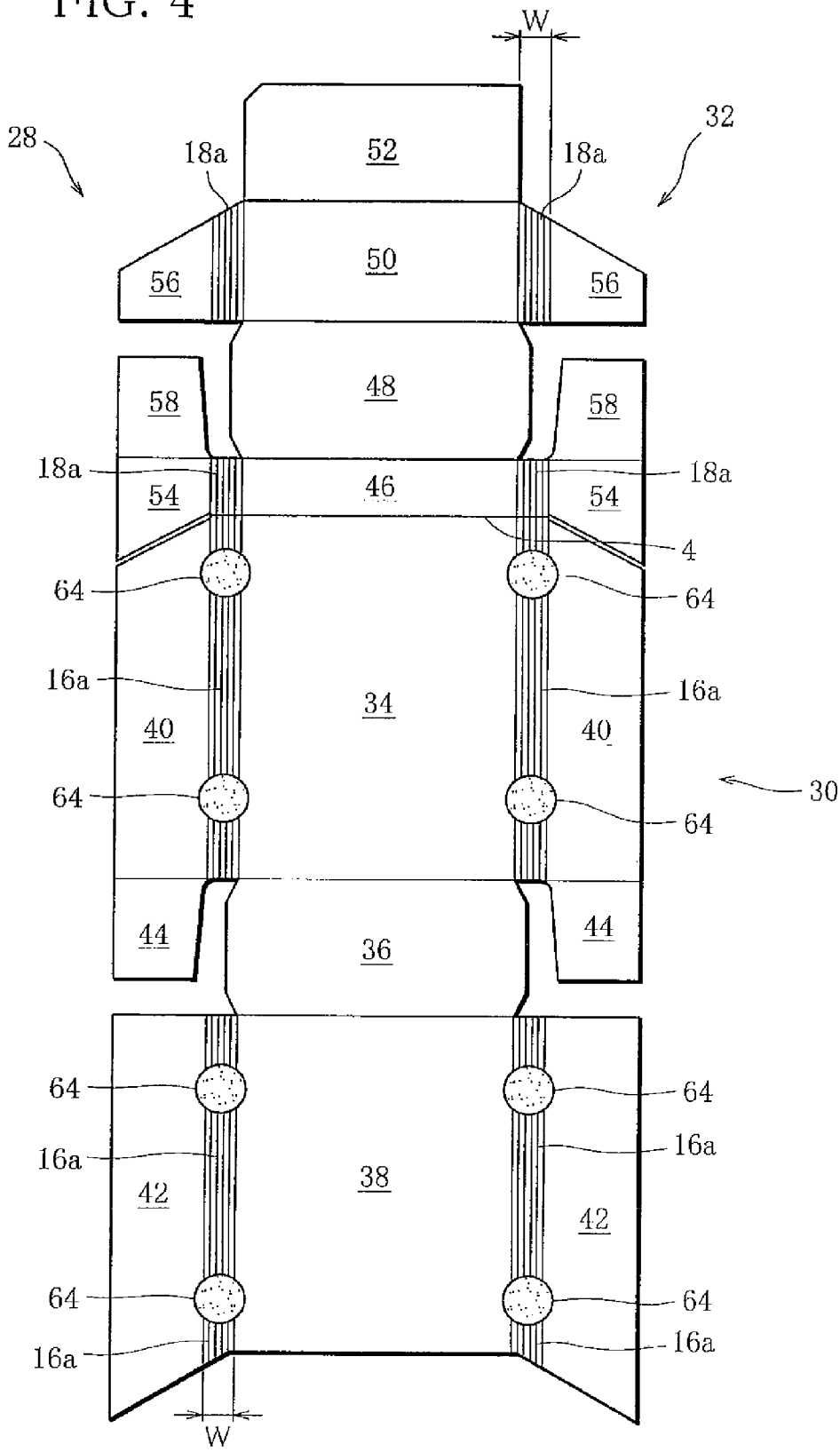
FIG. 4 shows a blank for fabricating a box body and a lid of the package shown in FIGS. 1 and 2.

A structural element that further characterizes the package of the invention will be clarified in descriptions of a blank for fabricating the box body 8 and the lid 6. An inner face of the blank is shown in FIG. 4.

A blank 28 is made of longitudinally-grained cardboard. The longitudinally-grained cardboard here means cardboard in which fibers forming the cardboard are arranged in a longitudinal direction of the blank 28.

As a basic form and folding process of the blank 28 are publicly known, the basic form of the blank 28 will be briefly described below.

The blank 28 is roughly divided into a main section 30 forming the box body 8 and a sub section 32 forming the lid 6. The sections 30 and 32 are adjacent to each other in the longitudinal direction of the blank 28 and connected to each other through the self hinge 4.

The main section 30 includes a rear panel 34, a bottom panel 36, and a front panel 38. The panels 34, 36 and 38 are arranged in the longitudinal direction of the blank 28 in the order from the sub section 32 side, or the self hinge 4 side. Each two panels arranged adjacent to each other in the longitudinal direction of the blank 28 are connected together through transverse fold lines. The transverse fold lines extend in a direction orthogonal to the longitudinal direction of the blank 28. The panels 34, 36 and 38 are parts for forming the rear, bottom and front walls, respectively, of the box body 8.

Inner side flaps 40 are connected to both sides of the rear panel 34 through longitudinal fold lines. The longitudinal fold lines extend in the longitudinal direction of the blank 28. The inner side flaps 40 are parts for forming interior layers of side walls of the box body 8. Outer side flaps 42 are connected to both sides of the front panel 38 through longitudinal fold lines. The outer side flaps 42 are parts for forming exterior layers of the side walls. In short, the side walls of the box body 8 are formed by superposing the inner side flaps 40 upon the respective outer side flaps 42.

Referring to FIG. 4, inner bottom flaps 44 are connected to lower ends of the inner side flaps 40 through transverse fold lines. The inner bottom flaps 44 function as reinforcing members of the bottom panel 36. The inner bottom flaps 44 are parts for forming interior layers of the bottom wall of the box body 8.

The sub section 32 includes a rear panel 46, a top panel 48, a front panel 50 and an inner front panel 52. The panels 46, 48, 50 and 52 are arranged in the longitudinal direction of the blank 28 in the order from the rear panel 34 side. Again, each two panels arranged adjacent to each other in the longitudinal direction of the blank 28 are connected together through transversal fold lines. The rear panel 46, the top panel 48 and the front panel 50 are parts for forming the rear, upper and front walls, respectively, of the lid 6. The inner front panel 52 functions as a reinforcing member of the front panel 50. The inner front panel 52 is a part for forming an interior layer of the front wall of the lid 6.

Inner side flaps 54 are connected to both sides of the rear panel 46 through longitudinal fold lines. Outer side flaps 56 are connected to both sides of the front panel 50 through longitudinal fold lines. In FIG. 4, the inner and outer side flaps 54 and 56 disposed on the same side are parts for forming side walls of the lid 6 by being superposed upon each other.

Again in FIG. 4, inner top flaps 58 are connected to upper edges of the inner side flaps 54 through transverse fold lines. The inner top flaps 58 function as reinforcing members of the top panel 48 and are parts for forming an interior layers of the upper wall of the lid 6.

The transverse and longitudinal fold lines are usually formed of indented lines. However, the longitudinal fold lines for forming the arc-shaped longitudinal edges 16 and 18, that is, folded zones 16*a* and 18*a*, are made of a plurality of longitudinal grooves, instead of indented lines.

Figure 5:
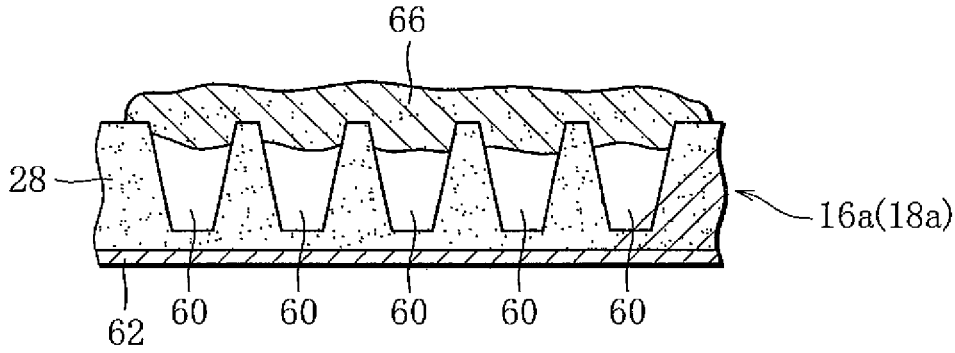
FIG. 5 is a sectional view showing longitudinal fold lines of the blank of FIG. 4 in an enlarged scale.

The longitudinal grooves extend parallel to one another within width W of the folded zones along a width direction of the blank 28. FIG. 5 is a sectional view of longitudinal grooves 60 forming the folded zone 16*a* in an exaggerated form. The longitudinal grooves 60 are made, for example, by forming cuts in the longitudinal direction of the blank 28, that is, in a direction of arrangement of fibers in the longitudinally-grained cardboard. The number of the longitudinal grooves 60 included in the folded zone is preferably five to eight.

As is clear from FIG. 5, the longitudinal grooves 60 reduce the blank 28 in thickness and increase the flexibility of the folded zones 16*a* and 18*a*. The longitudinal grooves 60 absorb a difference between arc length of outer surfaces of the arc-shaped longitudinal edges 16 and 18 and arc length of inner surfaces thereof. This facilitates the folding of the folded zones 16*a* and 18*a* when the blank 28 is folded along the folded zones 16*a* or 18*a*. The longitudinal grooves 60 forming the folded zones 16*a* and 18*a* are not exposed in the outer surfaces of the arc-shaped longitudinal edges 16 and 18. The longitudinal grooves 60 then provide smooth outer surfaces to the arc-shaped longitudinal edges 16 and 18.

Since the folded zones 16*a* and 18*a* are flexible as mentioned above, the preliminary folding of the folded zones is unnecessary. It is then possible to use an ordinary wrapping machine to fold the blank 28 and easily fabricate the package shown in FIGS. 1 and 2.

As illustrated in FIG. 5, a garnish layer 62 made, for example, of aluminum or resin is formed on an outer surface of the blank 28. The garnish layer 62 covers the entire outer surface of the blank 28. The garnish layer 62 not only adorns the appearance of the package but compensates the reduction of the thickness in the folded zones 16*a* and 18*a* of the blank 28, attributable to the presence of the longitudinal grooves 60. That is to say, the garnish layer 62 also functions as a reinforcing element that compensates an insufficiency in strength of the folded zones 16*a* and 18*a*. Accordingly, when the blank 28 is folded along the folded zones 16*a* and 18, there occurs no fracture in the arc-shaped longitudinal edges 16 or 18.

The box body 8 may include at least one reinforcement patch provided onto the inner surface thereof. As is obvious from FIG. 4, reinforcement patches 64 are disposed in given positions in the inner face of the blank 28 prior to the folding of the blank 28. To be concrete, each two of the reinforcement patches 64 are disposed in the corresponding folded zone 16*a* forming the arc-shaped longitudinal edges 16. The two reinforcement patches 64 are disposed away from each other in a longitudinal direction of the corresponding folded zone 16*a* and each have a size enough to intersect the folded zone 16*a*.

Preferably, one of the two reinforcement patches 64 disposed in the corresponding the folded zone 16*a* is positioned in an end portion of the folded zone 16*a*, which forms the opening of the box body 8.

Figure 6:
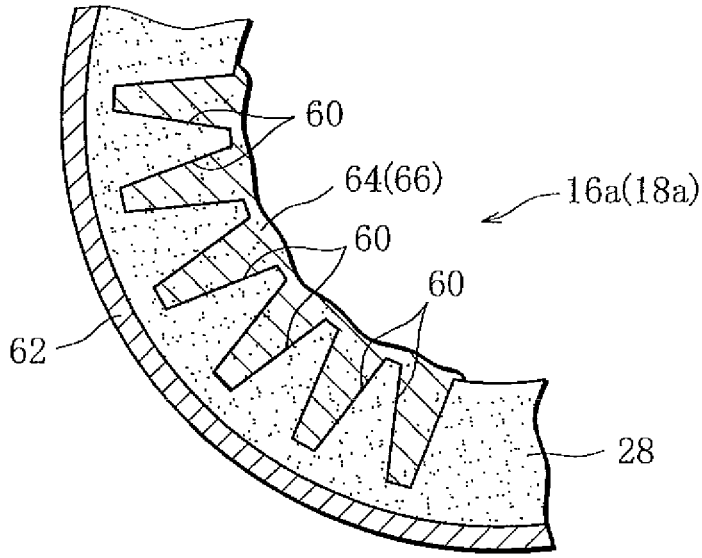
FIG. 6 is a sectional view showing an arc-shaped longitudinal edge that is formed by folding the longitudinal fold lines.

More specifically, each of the reinforcement patches 64 is provided to the blank 28 by applying fluid glue 66 to the blank 28 prior to the folding of the blank 28. The glue 66 that has just been applied is not a hindrance to the folding of the blank 28 and enters the longitudinal grooves 60 as shown in FIG. 6 due to the folding of the blank 28. After the package is fabricated, the reinforcement patches 64 made of the hardened glue 66 provide a sufficient strength to the arc-shaped longitudinal edges 16 in cooperation with the garnish layer 62.

Although the blank 28 is made of longitudinally-grained cardboard as described, and moreover, the longitudinal grooves 60 forming the folded zones 16*a* reduce the strength of the arc-shaped longitudinal edges 16, the reinforcement patches 60 increase the rigidity of the arc-shaped longitudinal edges 16 after the fabrication of the package. For this reason, with or without the longitudinal grooves 60, the fabricated package is hardly deformed by external force. Since the reinforcement patches 60 are located near the opening of the box body 8, the open end 12 of the box 2 is suppressed from being deformed. This ensures and facilitates the opening and closing, especially the closing, of the lid 6.

The reinforcement patches 64, or the glue 66, can be used to bond the box body 8 and the inner frame 10 to each other, eliminating the use of an adhesive agent for bonding the inner frame 10 and the box body 8 together.

It is not preferable that the reinforcement patches 60 be provided to the arc-shaped longitudinal edges 18. This is because the arc-shaped longitudinal edges 18 are shorter than the arc-shaped longitudinal edges 16, and the lid 6 has sufficient strength with or without the arc-shaped edges 18 and does not need to be reinforced by the reinforcement patches 64. If the reinforcement patches 64 are provided to the arc-shaped longitudinal edges 18, there occurs a problem that the glue forming the reinforcement patches 64 sticks to the inner wrapping material of the inner pack IP.

Figure 7:
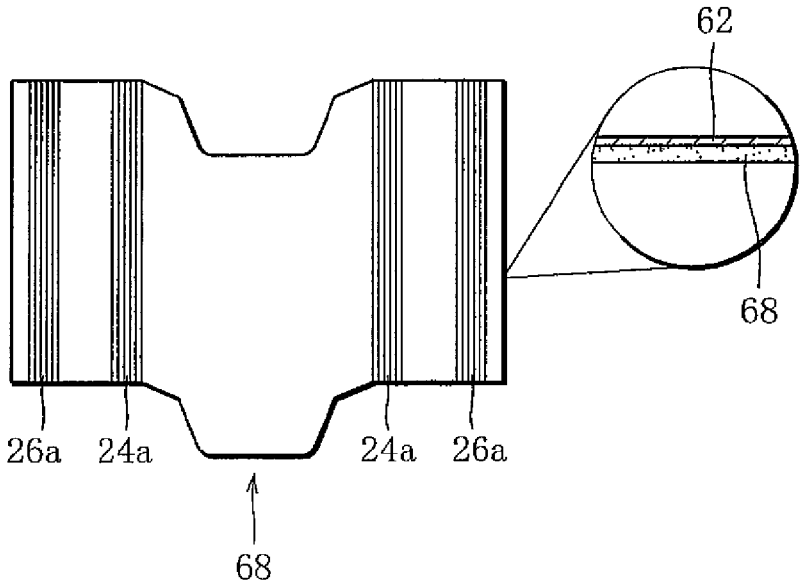
FIG. 7 shows a blank for fabricating an inner frame shown in FIG. 2.

FIG. 7 shows a paper blank 68 for fabricating the inner frame 10.

The blank 68 includes folded zones 24*a* and 26*a* for forming the arc-shaped longitudinal edges 24 and 26 (see FIG. 2). The folded zones 24*a* and 26*a* are also formed of a plurality of longitudinal grooves similar to the longitudinal grooves 60. The blank 68 may also have a garnish layer 62 similar to the above-mentioned garnish layer in an entire outer surface thereof.

Figure 8:
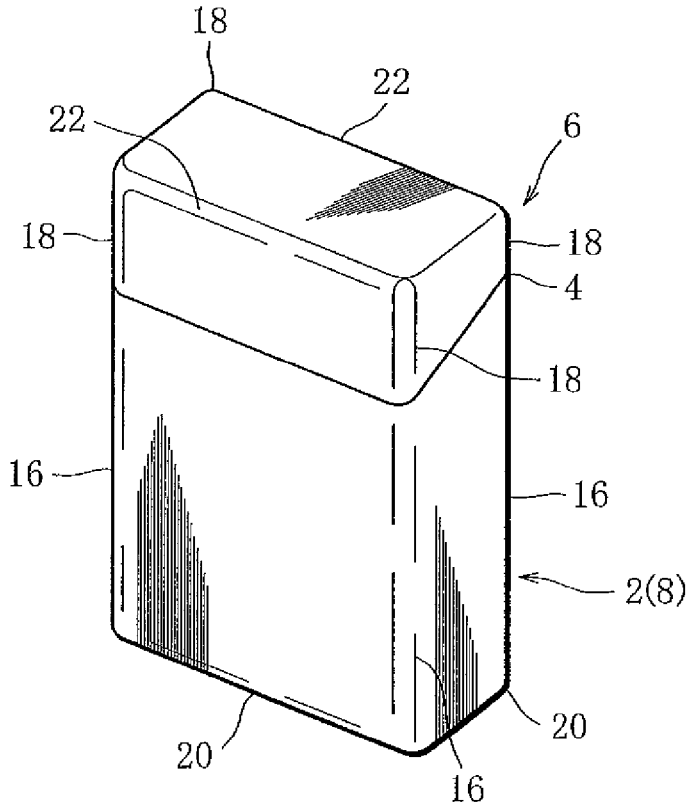
FIG. 8 is a perspective view showing a closed state of a package of a second embodiment.
Figure 9:
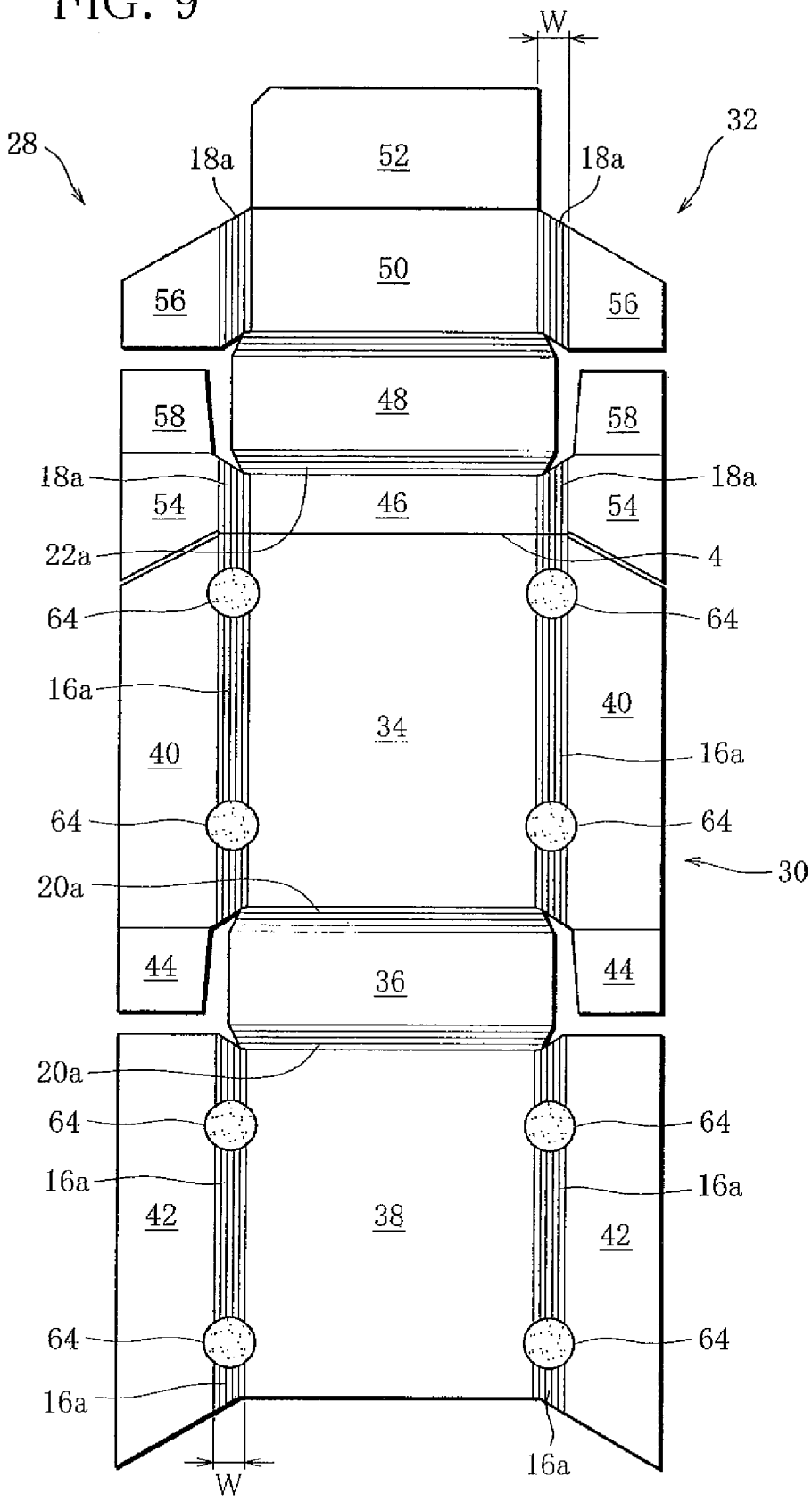
FIG. 9 shows a blank for fabricating a box body and lid of the package shown in FIG. 8.

FIGS. 8 and 9 show a package and a blank, respectively, of a second embodiment.

The package of the second embodiment differs from that of the first embodiment only in that front and rear transverse edges of a bottom wall of the box body 8 and front and rear transverse edges of the upper wall of the lid 6 are made of arc-shaped transverse edges 20 and 22. The arc-shaped transverse edges 20 and 22 each have an arc-like shape in longitudinal section of the package.

The package shown in FIG. 8 is fabricated by folding the blank 28 in FIG. 9. The blank 28 in FIG. 9 includes folded zones 20*a* and 22*a* for forming the arc-shaped transverse edges 20 and 22. The folded zones 20*a* and 22*a* are made of a plurality of longitudinal grooves similar to the longitudinal grooves 60. The longitudinal grooves in the second embodiment extend in a transverse direction orthogonal to the longitudinal direction of the blank 28.

The invention is not limited to the packages and blanks of the first to fourth embodiments and may be modified in various ways.

For example, the package of the invention requires at least one pair of the arc-shaped longitudinal edges 16 and 18, and the arc-shaped transverse edges 20 and 22 are not indispensable. The longitudinal grooves 60 may have different sectional shapes, instead of the sectional shape shown in the drawing. The inner frame may be an ordinary inner frame without the folded zones.

Lastly, the invention is applicable not only to a hinged-lid package but also to a tongue-lid package.

The invention claimed is:

1. A package of rod-shaped smoking articles, comprising:

a box including an open end and containing an inner pack of rod-shaped smoking articles, said box further including a longitudinal edge, which extends in a longitudinal direction of said box to have an arc-like shape in cross section of said box, to be located in at least one corner edge, the arc-like shape of the longitudinal edge being realized by a plurality of longitudinal grooves which are formed only in an inner surface of the longitudinal edge and extend in the longitudinal direction of said box;

a lid connected to said box through a hinge, for opening/closing the open end of said box; and reinforcing patches placed in the inner surface of the longitudinal edge and located only near the top and the bottom of the longitudinal edge for maintaining the arc-like shape of the longitudinal edge, wherein said reinforcing patches are arranged across the longitudinal grooves, and are positioned as spot areas near the open end of said box and near the bottom of said box, said reinforcing patches being formed by hardened glue made of fluid glue applied onto the inner surface of the longitudinal edge and locally filling the longitudinal grooves so that said reinforcing patches occupy said spot areas within the whole length of the longitudinal edge.

2. The package of rod-shaped smoking articles according to claim 1, wherein the package further comprises a garnish layer covering an entire outer surface of said box.

3. The package of rod-shaped smoking articles according to claim 1, wherein a bottom wall of said box and an upper wall of said lid each include two transverse edges extending orthogonal to the longitudinal direction of said box, and the transverse edges each have an arc-like shape in longitudinal section of said box and lid.

4. The package of rod-shaped smoking articles according to claim 1, wherein said box includes a box body and an inner frame provided to the box body and forming the open end of said box; and the inner frame is formed in the shape of letter "U" enclosing the inner pack and has two corner edges located in a front wall-side of said box.

5. The package of rod-shaped smoking articles according to claim 4, wherein the two corner edges of the inner frame are formed in an arc-like shape as with the longitudinal edges of said box.

6. The package of rod-shaped smoking articles according to claim 5, wherein the inner frame further has two lateral edges positioned in a rear wall-side of said lid, and the lateral edges are formed in an arc-like shape as with the longitudinal edges of said box.

7. The package of rod-shaped smoking articles according to claim 4, wherein said inner frame is provided which includes a garnish layer at least in an outer surface thereof.

8. The package of rod-shaped smoking articles according to claim 1, wherein the box and the lid are formed by a blank made of longitudinally-grained cardboard, the longitudinally-grained cardboard including fibers arranged in the longitudinal direction of the blank.

9. A blank for forming the box and lid of claim 1.

10. A package of rod-shaped smoking articles comprising:

a box, including an open end and containing an inner pack of rod-shaped smoking articles, said box further including four separate sets of longitudinal grooves defining four separate longitudinal corner edges which extend in a longitudinal direction of said box to have an arc-like shape in cross section of said box, said longitudinal grooves being formed only on an inner surface of the longitudinal corner edges and extending in the longitudinal direction of the box;

a lid connected to said box through a hinge, for opening/closing the open end of said box; and reinforcing patches placed in the inner surface of the longitudinal edge and located only near the top and near the bottom of the longitudinal edge for maintaining the arc-like shape of the longitudinal edge, wherein said reinforcing patches are arranged across the longitudinal grooves and are positioned as a spot area near the open end of said box and near the bottom of said box, said reinforcing patches being formed by hardened glue made of fluid glue applied onto the inner surface of the longitudinal edge and locally filling the longitudinal grooves so that said reinforcing patches occupy said spot area within the whole length of the longitudinal edge.

11. The package of rod-shaped smoking articles according to claim 10, wherein said lid includes four longitudinal edges corresponding to the longitudinal edges of said box, and the longitudinal edges of said lid are made in an arc-like shape in cross section of said lid.

12. A blank for forming the box and lid of claim 10.

* * * * *